US005283725A

United States Patent [19]

Penza

[11] Patent Number: 5,283,725

[45] Date of Patent: Feb. 1, 1994

[54] LAMP DEVICE

[76] Inventor: R. Scott Penza, 8829 National Blvd. #1094, Culver City, Calif. 90232

[21] Appl. No.: 813,959

[22] Filed: Dec. 24, 1991

[51] Int. Cl.[5] ..... F21S 5/00; F21V 13/00

[52] U.S. Cl. ..... 362/414; 362/457; 362/362; 362/346; 362/806

[58] Field of Search ..... 362/414, 457, 458, 806, 362/812, 362, 253, 103, 105, 341, 346, 351

[56] References Cited

U.S. PATENT DOCUMENTS

| | | | |
|---|---|---|---|
| D. 34,537 | 5/1901 | Semler . | |
| D. 98,475 | 2/1936 | Holstein . | |
| D. 225,260 | 11/1072 | Morris . | |
| D. 268,530 | 4/1983 | Ament . | |
| D. 269,818 | 7/1983 | Ament . | |
| D. 298,060 | 10/1988 | Johannsen . | |
| D. 311,594 | 10/1990 | Medina . | |
| 883,865 | 4/1908 | Dahn et al. . | |
| 1,261,824 | 4/1918 | La Vine . | |
| 2,066,771 | 1/1937 | Doane | 362/351 X |
| 2,146,591 | 2/1939 | Oday | 362/351 X |
| 2,167,458 | 7/1939 | Lieberman | 362/414 |
| 2,725,462 | 11/1955 | Vorgang . | |
| 2,878,373 | 3/1959 | Bramming | 362/414 X |
| 3,388,249 | 6/1968 | Siegel et al. . | |
| 3,962,678 | 6/1976 | Kurokawa . | |
| 4,234,910 | 11/1980 | Price . | |
| 4,254,451 | 3/1981 | Cochran, Jr. . | |
| 4,616,297 | 10/1986 | Liu . | |
| 4,843,530 | 6/1989 | Mori et al. . | |
| 5,008,793 | 4/1991 | Copeland . | |

FOREIGN PATENT DOCUMENTS

| | | | |
|---|---|---|---|
| 1284005 | 1/1962 | France | 362/414 |

*Primary Examiner*—Larry Jones

*Attorney, Agent, or Firm*—Blakely, Sokoloff, Taylor & Zafman

[57] ABSTRACT

A lamp device having the ability to produce both a directed illumination for reading and a shaded illumination for general lighting of a room. The preferred embodiment of the lamp device comprises a lamp shade in the form of sunglasses attached to the periphery of a lamp housing. An upright stem is provided having a top end attached to the lamp housing and a bottom end affixed to a base. The lamp housing is disposed within a central cavity defined by translucent frame and temple members comprising the lamp shade. The lamp housing contains a first light pointed in a generally downward direction for the production of a directed illumination. Also within the lamp housing are a plurality of incandescent lights adjacent to the frame and temple members which project light through said members to produce shaded illumination in three directions. The lamp shade is detachable from the lamp housing such that a plurality of lamp shades having different colors and translucence may be used to produce a variety of shaded illuminations. The lamp housing is further detachable from the upright stem such that the lamp housing can be used with different mounting means in a variety of settings.

24 Claims, 2 Drawing Sheets

LAMP DEVICE

BACKGROUND OF THE INVENTION (1) Field of the Invention

The present invention relates to apparatus and methods which produce either a focused illumination of a specific area for reading or working, or a general illumination of an indeterminate area for general vision. More particularly, this device is especially suited for use as both a reading lamp or a general illumination lamp. However, the present invention also enables the lamp housing and the lamp shade of the device to be used with mounting means other than those directed to a flat surface, and for other purposes which incorporate either of the illumination features, such as a display light or a night light.

(2) Prior Art

Conventional lamps are generally of two types. First, there are those for use as a reading light in which a directed beam (or "directed illumination"), is focused on a specific area to facilitate viewing of reading material or the like. Second, there are lamps, such as ceiling or floor lamps, which provide a general illumination (or "shaded illumination") of a large area for the purpose of enabling one to see what is in the area.

Because both types of lamps are ordinarily needed in the home or office to perform both functions, users of the lamps must purchase at least one of each. After placing both lamps in their respective areas in the home or office, it is common for the user to have both lamps on at the same time so that the user may work at his desk or table while still being able to see around the room. Furthermore, in order to use both lamps simultaneously or otherwise, the user must turn each lamp on or off individually. Therefore, it is an object of the present invention to provide a single lamp device which can produce both a directed illumination and a shaded illumination to serve the particular need of the user. It is another object of the invention to provide a lamp device which can supply both types of illumination either simultaneously or alternatively from a single switch.

Within the art of general illumination lamps, the lamp usually comprises a lamp shade placed over a high-wattage bulb attached to the stem or the base of a lamp. For the most common lamps, the lamp shade takes the form of a translucent cylinder attached to the stem of the lamp such that the bulb is centrally located within the cavity of the cylinder. The problem with such a design is that a large proportion of the light produced by the bulb is radiated out of the top and bottom ends of the lamp shade, and not through the translucent portion of the lamp shade to more distant areas of the room. Hence, this design produces very little shaded illumination, but rather reflects direct light from the floor and ceiling, causing the user to hurt his eyes if he looks directly at the lamp shade. In addition, to obtain shaded illumination projected throughout an entire room, the user must consequently use a bulb of more intensity, thus using more electricity than necessary. Therefore, it is another object of the invention to provide a lamp device which projects a larger proportion of light directly through the sides of the lamp shade so as to light up a room with genuine shaded illumination in the form of a soft glow. A further object of the invention is to provide a lamp device which uses lower wattage bulbs to produce the shaded illumination and which will not cause temporary blindness by one looking directly at the lamp shade.

In addition to the above problems, general illumination lamps are further disliked because they normally only produce one type of shaded illumination, that is off-white. It is very difficult to find lamp shades having different shades or colors so that the user can lighten up a room in a different way with a not-so-dull shade or color. Even if this is possible, the user will still have trouble finding lamp shades which have the same style as the lamp itself or which properly fit the lamp or the connection thereto. Hence, it is a further object of the invention to provide a lamp device of the kind described above that may be configured with lamp shades of varying colors and translucence to enable the lamp device to produce any one of a variety of colorful shaded illuminations. In this respect, it is another object of the invention to provide these lamp shades with the ability to emit a neon-like glow to further enhance the color of the shaded illumination and to produce a shaded illumination which is softer on the eyes.

Both of the conventional general illumination lamps and reading lamps are further functionally inhibited by the structure of their bases which are usually designed for placement on flat surfaces. For instance, a normal desk lamp cannot be easily used for reading while in bed, and a general illumination lamp cannot be easily hung on a wall. However, it is an object of the invention to provide a lamp device having a multiplicity of mounting means wherein the lamp housing and the lamp shade may be used in a variety of different settings.

BRIEF SUMMARY OF THE INVENTION

The present invention discloses a lamp device having the ability to produce both a directed illumination for reading and a shaded illumination for general lighting of a room in an artistic and aesthetically pleasing manner. The preferred embodiment of the lamp device comprises a lamp shade in the form of sunglasses attached or molded to the periphery of a lamp housing. An upright stem is provided having a top end attached to the lamp housing and a bottom end affixed to a base.

The lamp shade comprises two translucent temple members attached to the ends of a translucent frame member and extending therefrom in a generally perpendicular direction. Within a central cavity defined by the frame and temple members, a lamp housing is disposed, having a light pointed in a generally downward direction for the production of a directed illumination. Also within the lamp housing are a plurality of lights adjacent to the frame and temple members which project light through the members to produce shaded illumination in three directions.

Each of the frame and temple members are manufactured out of a colored acrylic or luminescent material such that when the lights adjacent to these members are enabled, a neon-like glow is emanated from these members of the lamp shade. The frame member also comprises two spectacle lenses shaded to a particular translucence for projection of the shaded illumination to the various regions of a room.

In order to produce a variety of shaded illuminations, the lamp shade may be configured with lamp shades having different colors and translucence. In addition, the lamp housing is detachable from the upright stem such that the lamp housing, with a lamp shade thereon, can be mounted in several ways for use in a variety of settings.

DETAILED DESCRIPTION OF THE INVENTION

Figure 1:
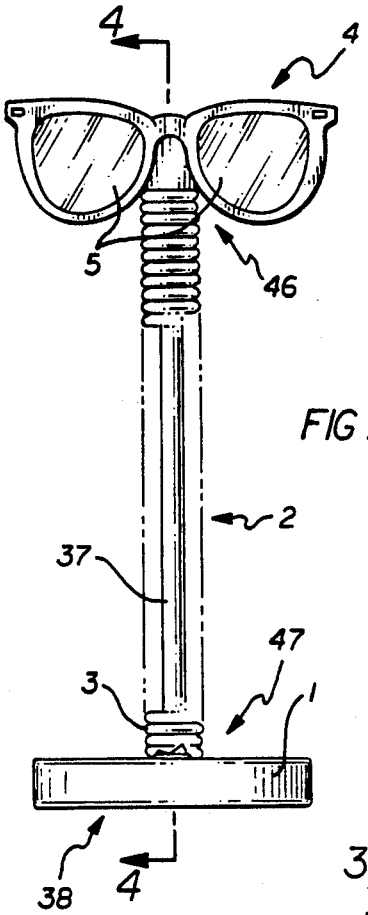
FIG. 1 is a front view of the invention.
Figure 3:
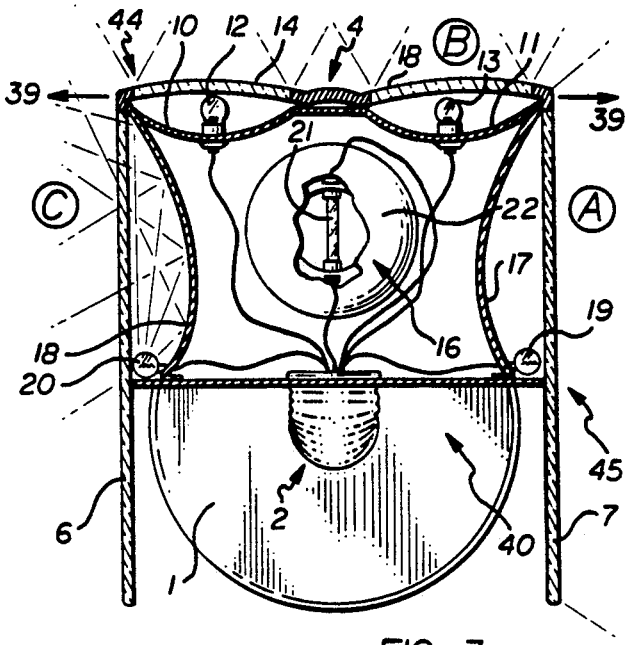
FIG. 3 is a top view of the invention with a break-away of the lamp housing and the reflectors to show the arrangement of the bulbs therein.
Figure 2:
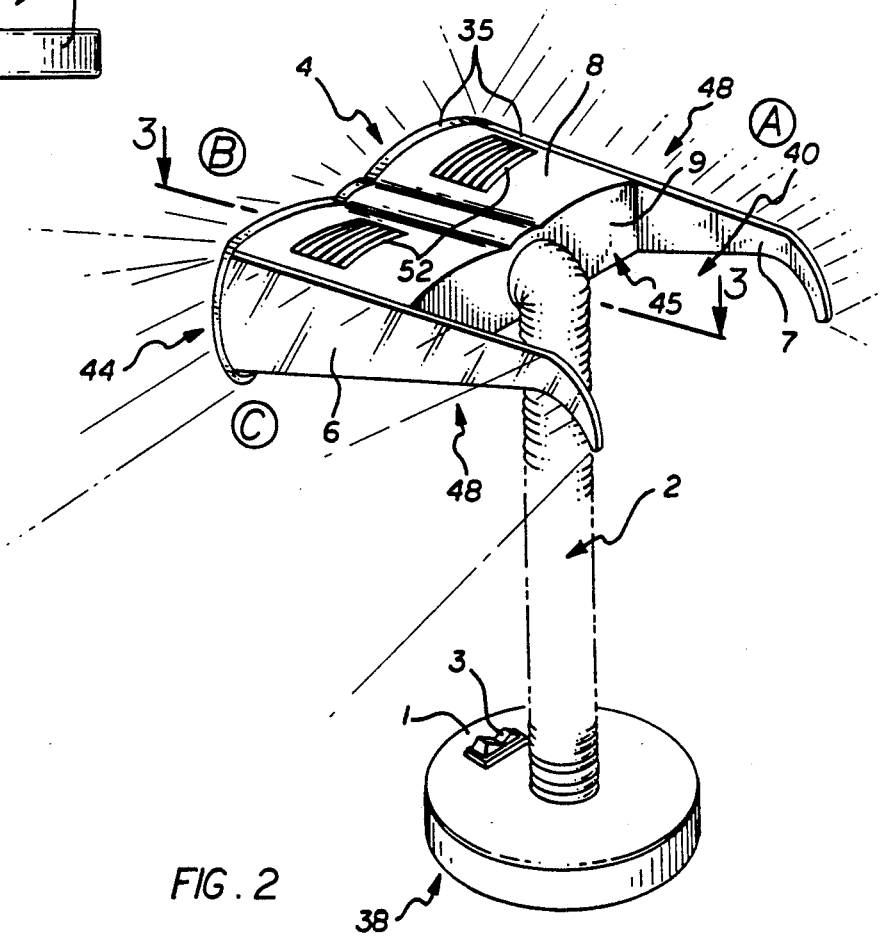
FIG. 2 is an elevated perspective view of the rear of the invention.
Figure 4:
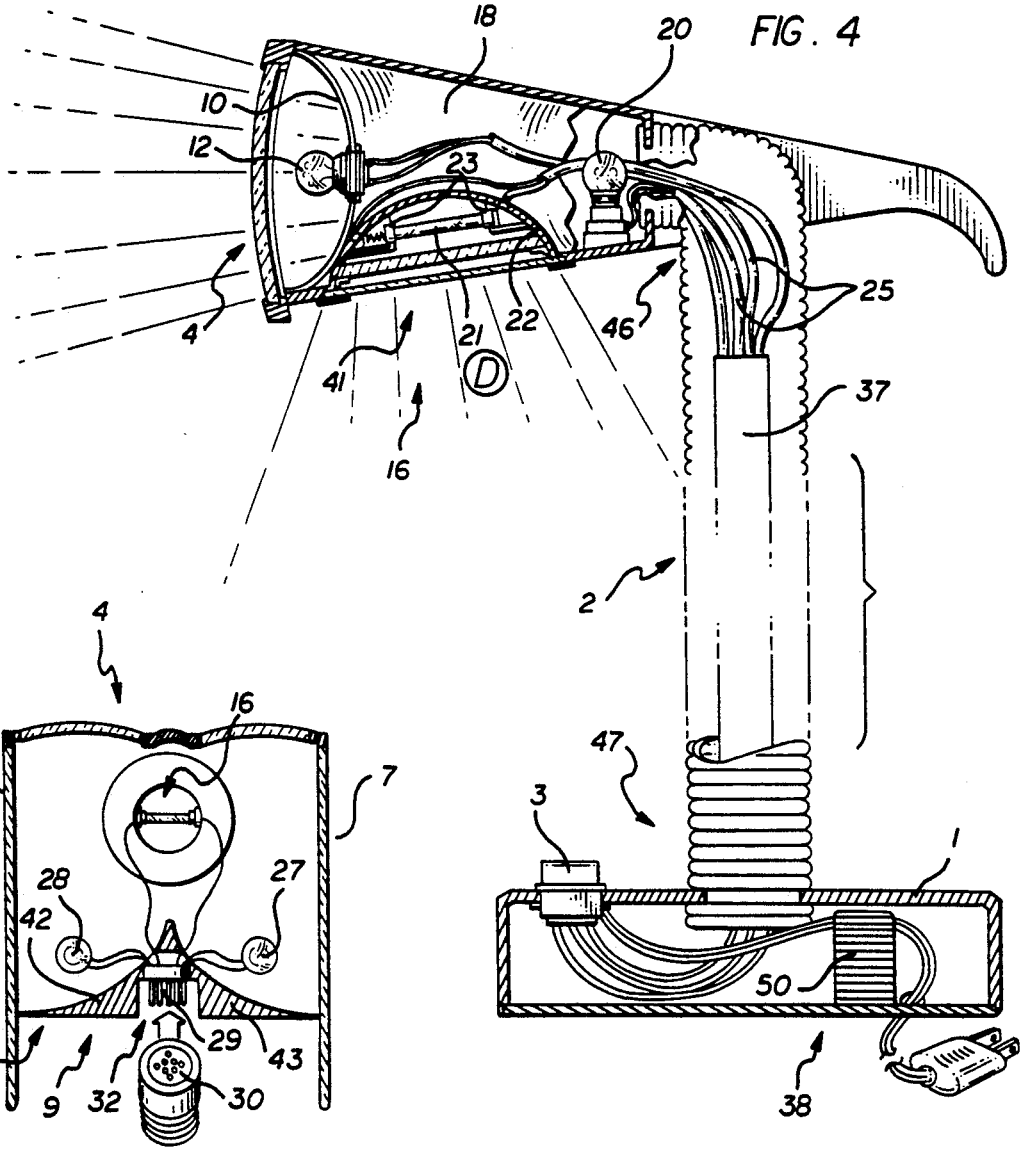
FIG. 4 is a side view of the invention with a break-away of a temple member, the lamp housing and the reflectors to show the arrangement of the bulbs therein.

The present invention discloses a lamp device comprising a lamp shade 44 in the form of sunglasses attached to the periphery 35 of a lamp housing 45. An upright stem 2 is provided having a top end (46) attached to the lamp housing 45 and a bottom end 47 affixed to a base 1.

The upright stem 2 is of a goose-neck type stem which is flexible to provide for movable support of the lamp housing 45. Within the upright stem 2 a lengthwise conduit 37 is provided having electrical wiring 25 therein to electrically connect the lamp housing 45 to the base 1. The upright stem 2 is made having a diameter of approximately one inch and a height of approximately twelve to eighteen inches.

The base 1 of the lamp device is in the form of a disc having a diameter of approximately six inches and a width of approximately one inch so as to provide sturdy support of the lamp housing 45 regardless of the inclination of the upright stem 2. The base 1 has a bottom 38 adapted for placement on a flat surface and is made from a dense material, such as steel, ceramic or the like, to provide further support to the lamp device. The base 1 is generally hollow to allow for passage of the electrical wiring 25 and to provide a housing for a step-down transformer 50 when the lamp device is used with bulbs of less than 120 volts.

The lamp shade 44 comprises three translucent sides, including a first temple member 7 and a second temple member 6 and a frame member 4, for the projection of shaded illumination A, B, C. The temple members 6, 7 are attached to the ends of the frame member 4 and extend at a generally perpendicular angle to a longitudinal axis 39 of the frame member 4 so as to define a central cavity 40 between the temple members 6, 7. The frame member 4 includes spectacle lenses 5 which are manufactured out of a material such as plastic or glass and are shaded to a desired translucence for the projection of a first shaded illumination B to distant regions of a room. Each of the frame and temple members 4, 6, 7 not including the spectacle lenses 5 therein, are manufactured out of a colored acrylic material for production of a neon-like glow. The acrylic material may be manufactured having several different colors, including but not limited to yellow, green, orange, red, purple and blue, for lighting up a room with a soft, colored glow. As one skilled in the art would realize, many different materials may be used for the frame and temple members 4, 6, 7 to produce the neon-like glow such as, but not limited to, materials having luminescent properties and a variety of translucent, colored plastics.

A lamp housing 45 is disposed within the central cavity 40 of the lamp shade 44 such that the lamp shade 44 is fitted to the periphery 35 of the lamp housing 45. In addition to the frame and temple members 4, 6, 7 defining the shape of the lamp housing 45, the lamp housing 45 is further enclosed by a top 8 having vents 52 for ventilation, a bottom 48 and a rear 9 which are opaque to prevent the light therein from being projected through these portions. Within the lamp housing 45, a first light 16 is positioned over an aperture 41 in the bottom 48 of the lamp housing 45. A corresponding concave first reflector 22 fitted to the size of the aperture 41 is positioned over the first light 16 so as to produce a directed illumination D in a generally downward direction for the viewing of reading material or the like. The first light 16 may comprise a 20 watt halogen bulb 21 having ends adapted to fit into bulb receptacles 23 affixed to the first reflector 22. However, a variety of other bulbs, such as incandescent or fluorescent bulbs, having the ability to project a directional light for reading may also be used.

In addition to the first light 16, at least one incandescent light is disposed within the lamp housing 45 for the projection of light rays through the translucent frame and temple members 4, 6, 7 of the lamp shape 44. In the preferred embodiment, a first and a second incandescent light 12, 13 are positioned adjacent to the spectacle lenses 5. Corresponding first and a second concave reflectors 10, 11 are adapted to encapsulate the first and second incandescent lights 12, 13 and fit over a left and a right frame portion 14, 15 of the frame member 4, respectively, so as to provide a first shaded illumination B through the entirety of the frame member 4, including the spectacle lenses 5. A third and fourth incandescent lights 19,20 are positioned in the rear 9 of the lamp housing 45 adjacent to the first temple member 7 and the second temple member 6, respectively. Corresponding third and fourth concave reflectors 17, 18 are adapted to encapsulate the third and fourth incandescent lights 19, 20 and fit over those portions of the temple members 6, 7 directly adjacent to the lamp housing 45. In this manner, the light produced by the third and fourth incandescent lights 19, 20 is projected through the temple members 6, 7 to produce a third and fourth shaded illumination A, C, respectively, uniform with the level of illumination of the first shaded illumination B. The incandescent lights 12, 13, 19, 20 are manufactured in the form of a regular flashlight bulbs, or other small incandescent bulbs of approximately twelve volts, which are fitted within electrical fixtures.

Along with the plurality of lights 12, 13, 16, 19, 20 provided in the lamp device, the invention also discloses a means of enabling the lights 12, 13, 16, 19, 20 either alternatively or in combination. This is performed by providing a three-way rocker switch 3 located in the base 1 of the lamp device. In a first position, the first, second, third, and fourth incandescent lights 12, 13, 19, 20 are enabled to produce the first, second and third shaded illuminations A, B, C. In a second position, all of the lights 12, 13, 16, 19, 20 are enabled to produce all of the illuminations A, B, C, D. Finally, in a third position, none of the lights 12, 13, 16, 19, 20 are enabled so that the lamp is off.

Figure 5:
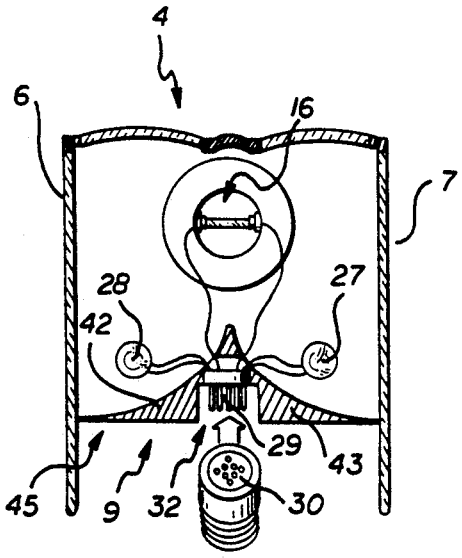
FIG. 5 is a top view of an alternate embodiment of the invention with a break-away of the lamp housing to show a different arrangement therein.

In an alternate embodiment of the present invention, as shown in FIG. 5, the lamp housing 45 is provided with only a fifth and sixth incandescent lights 27, 28 positioned in the rear 9 of the lamp housing 45. Corresponding fifth and sixth concave reflectors 42, 43 are positioned behind the fifth and sixth incandescent lights 27, 28 with the aperture of the reflectors 42, 43 opening towards the frame member 4. The fifth and sixth concave reflectors 42, 43 abut at one end near the center of the lamp housing 45 so that the light produced by the fifth and sixth incandescent lights 27, 28 is directed toward both sides of the lamp shade 44. These reflectors 42, 43 enable the light rays of fifth and sixth incandescent lights 27, 28 to reach substantially all portions of the frame and temple members 4, 6, 7.

Figure 6:
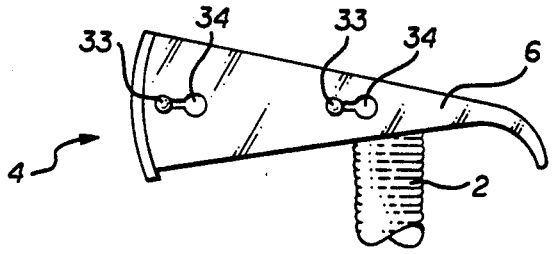
FIG. 6 is a side view of an alternate embodiment of the invention showing a means of attachment between the lamp shade and the lamp housing.

In an alternate embodiment, as shown in FIG. 6, the lamp device may be configured with several different lamp shades 44 of varying color and translucence to enable the lamp device to project shaded illumination in any one of a variety of colors and translucences. Each of the temple members 6, 7 of the lamp shade 44 is provided with two recesses 34 adapted to receive two corresponding pegs 33 affixed to the lamp housing 45. The recesses 34 comprise large apertures to permit passage of the heads of the pegs 33 and smaller apertures for reception of the stems of the pegs 33. The lamp shade 44 is secured to the lamp housing 45 by passing the heads of the pegs 33 through the large apertures and then sliding the temple members 6, 7 rearward until the stems of the pegs 33 are firmly fitted within the smaller apertures of the recesses 34.

In another embodiment, as shown in FIG. 5, a means of detachably connecting the upright stem 2 to the rear 9 of the lamp housing 45 is provided. A plurality of pins 30 are provided in a recess 32 in the rear 9 of the lamp housing 45 and are connected to the electrical wiring 25 within the lamp housing 45. In the top end 46 of the upright stem 2, a plurality of holes 30 electrically connected to the four-way switch 3 are adapted to receive the pins 29 of the lamp housing 45 so as to connect the lights 16, 27, 28 to the four-way switch 3. To attach the upright stem 2 to the lamp housing 45, the holes 30 in the top end 46 of the upright stem 2 are aligned with the pins 29 in the recess 32 of the lamp housing 45, whereby the top end 46 of the upright stem 2 may be simply pressed into the recess 32 of the lamp housing 45.

By detaching the lamp housing 45 from the upright stem 2 in this manner, or by other similar means, the lamp housing 45, with a particular lamp shade 44 attached thereto, may be used in a variety of ways in different settings. For instance, the lamp device may be hung on a wall or from a ceiling and operated by means of an extension chord adapted with a switch. In addition, a simple plug could be adapted to receive the pin connection 29 of the lamp housing 45 whereby the lamp housing 45 would then be directly inserted into an electrical outlet for use as a night light. Of course, when the lamp housing 45 is used as described in the above two embodiments, the three-way rocker switch 3 and the step-down transformer 50 would have to be emplaced within the lamp housing 45 itself. Furthermore, a pear-shaped clamp having electrical connections and either an extension cord or a battery built within the lamp housing 45 may be utilized to transform the lamp device into a portable, multi-purpose light of a convenient size. It should be noted that the particular methods of mounting the lamp device, and therefore its use within specific settings, are not limited to those herein disclosed.

I claim:

1. A lamp device for multi-purpose illumination, which comprises:

a base for support of said lamp device;

an upright stem having a bottom end and a top end, with said bottom end affixed to said base;

a lamp shade attached to said top end of said upright stem and having a frame member with ends and temple members, with said temple members attached to said ends of said frame member and extending therefrom at a generally perpendicular angle to a longitudinal axis of said frame member so as to define a central cavity between said temple members;

a first light disposed in said central cavity having a corresponding first reflector positioned over said first light to enable said first light to project a directed illumination for the viewing of reading material.

2. The lamp device of claim 1, wherein said lamp shade comprises means for providing shaded illumination emanating from said frame member and said temple members.

3. The lamp device of claim 2, wherein said frame member and said temple members are translucent, and said lamp device further comprises a second light disposed within said central cavity for the projection of light through said frame member and said temple members.

4. The lamp device of claim 2, wherein said temple members and said frame member comprise a material having luminescent properties for the production of said shaded illumination in the form of a neon-like glow emanating from said temple members and said frame members.

5. The lamp device of claim 3, wherein said temple members and said frame member comprise a colored, acrylic material for the production of said shaded illumination in the form of a neon-like glow emanating from said temple members and said frame members.

6. The lamp device of claim 3, wherein said lamp device further comprises means for enabling said first light and said incandescent lights alternatively or in combination to provide a lamp device having the ability of producing said illumination features from a single source.

7. The lamp device of claim 5, wherein said frame member comprises spectacle lenses being translucent for the production of said shaded illumination.

8. The lamp device of claim 7, wherein said lamp device further comprises a lamp housing having a top, a bottom and a rear corresponding to the shape of said frame member and said temple members, with said lamp housing having a second reflector corresponding to said second light for the direction of light rays from said second light toward said frame member and said temple members.

9. The lamp device of claim 8, wherein said lamp housing comprises means for detachable attachment of said frame member and said temple members to said lamp housing whereby a plurality of frame and temple members having different colors and different intensities of translucence may be attached to project a different color and intensity of said shaded illumination.

10. The lamp device of claim 9, wherein said lamp device comprises means for detachably connecting said lamp housing to said upright stem whereby said lamp housing may be functionally operated without attachment to said upright stem and said base.

11. A lamp device for multi-purpose illumination, which comprises:

a lamp shade having temple members, a frame member and lens members and being translucent to permit the passage of light through said lamp shade;

a lamp housing containing at least one incandescent light and having means for detachably attaching said lamp shade around a periphery of said lamp housing for projection of a shaded illumination from said lamp shade for general vision;

a first light disposed in said lamp housing and having a first reflector adjacent thereto for projection of a directed illumination.

12. The lamp device of claim 11, wherein said temple members and said frame member of said lamp shade comprise a colored, acrylic material for the production of said shaded illumination in the form of a neon-like glow emanating from said temple members and said frame member.

13. The lamp device of claim 11, wherein said temple members and said frame member comprise a material having luminescent properties for the production of said shaded illumination in the form of a neon-like glow emanating from said temple members and said frame members.

14. The lamp device of claim 11, wherein said lamp device further comprises means for enabling said incandescent lights and said first light alternatively or in combination to provide a lamp device having the ability of producing said illumination features from a single source.

15. The lamp device of claim 11, wherein said lamp device further comprises a base for support of said lamp device.

16. The lamp device of claim 15, wherein said lamp device further comprises an upright stem having a bottom end affixed to said base and a top end attached to said lamp housing for movable support thereof.

17. The lamp device of claim 16, wherein said lamp device comprises means for detachably connecting said lamp housing to said upright stem whereby said lamp housing may be functionally operated without attachment to said upright stem and said base.

18. A lamp device for multi-purpose illumination, which comprises:

a lamp shade having an appearance generally corresponding to a pair of sunglasses, said lamp shade comprising a material which produces a neon-like glow emanating from said lamp shade when illuminated;

means for illuminating said material of at least a part of said lamp shade to enable at least a part of said lamp shade to glow;

a lamp housing having means for attaching said lamp shade to said lamp housing;

a first light disposed in said lamp housing and having a first reflector disposed above said first light for projection of an unblocked, directed illumination in a generally downward direction.

19. A lamp device for multi-purpose illumination, which comprises:

a base for support of said lamp device;

an upright stem having a bottom end and a top end, with said bottom end affixed to said base;

a lamp shade attached to said top end of said upright stem and having a frame member with ends and first and second temple members attached to said ends of said frame member, respectively, said first and second temple members extending from said ends of said frame member so as to define an opening between said temple members;

a first light disposed in said opening between said temple members having a first reflector positioned proximate to said first light to project a directed illumination for the viewing of reading material.

20. The lamp device of claim 19, wherein said lamp shade comprises means for providing shaded illumination emanating from said frame member and said temple members.

21. The lamp device of claim 19, wherein said lamp device further comprises a lamp housing coupled to said upright stem and disposed within said opening between said first and second temple members for retaining at least said first light, said lamp housing having means for detachable attachment of said frame member and said temple members to said lamp housing to enable attachment of plurality of frame members and temple members having different colors and different intensities of translucence.

22. The lamp device of claim 20, wherein said frame member and said temple members are translucent, and said lamp device further comprises a second light disposed within said opening between said first and second temple members for the projection of light onto said frame member and said temple members.

23. The lamp device of claim 20, wherein said temple members and said frame member comprise a material having luminescent properties for the production of said shaded illumination in the form of a neon-like glow emanating from said temple members and said frame members.

24. The lamp device of claim 22, wherein said temple members and said frame member comprise a colored, acrylic material for the production of said shaded illumination in the form of a neon-like glow emanating from said temple members and said frame members.

* * * * *

UNITED STATES PATENT AND TRADEMARK OFFICE

CERTIFICATE OF CORRECTION

PATENT NO. : 5,283,725

DATED : February 1, 1994

INVENTOR(S) : Penza

It is certified that error appears in the above-identified patent and that said Letters Patent is hereby corrected as shown below:

In column 4 at line 27, please delete " shape " and insert -- shade --.

Signed and Sealed this

Twenty-fourth Day of February, 1998

*Attest:*

Bruce Lehman

BRUCE LEHMAN

*Attesting Officer*

*Commissioner of Patents and Trademarks*